US006058823A

United States Patent [19]

Michoud

[11] Patent Number: 6,058,823

[45] Date of Patent: May 9, 2000

[54] ULTRASONIC CUTTING DEVICE

[75] Inventor: Henri Michoud, Ebollies, France

[73] Assignee: Unir, Paris, France

[21] Appl. No.: 08/981,205

[22] PCT Filed: Jun. 18, 1996

[86] PCT No.: PCT/FR96/00932

§ 371 Date: Mar. 25, 1998

§ 102(e) Date: Mar. 25, 1998

[87] PCT Pub. No.: WO97/00159

PCT Pub. Date: Jan. 3, 1997

[30] Foreign Application Priority Data

Jun. 19, 1995 [FR] France ..... 95 07285

[51] Int. Cl.[7] ..... B26D 1/00

[52] U.S. Cl. ..... 83/508.3; 83/701; 83/932; 83/956

[58] Field of Search ..... 83/956, 701, 508.3, 83/932; 451/125

[56] References Cited

U.S. PATENT DOCUMENTS

| | | | |
|---|---|---|---|
| 2,651,148 | 9/1953 | Carwile | 83/956 X |
| 3,817,141 | 6/1974 | Simonetti | 83/956 X |
| 5,226,343 | 7/1993 | Rawson et al. | 83/701 X |
| 5,228,372 | 7/1993 | Harrop et al. | 83/701 X |
| 5,437,215 | 8/1995 | Hamilton | 83/956 X |
| 5,752,423 | 5/1998 | Rawson | 83/508.3 |

FOREIGN PATENT DOCUMENTS

| | | |
|---|---|---|
| 0 390 133 | 10/1990 | European Pat. Off. . |
| 0 584 670 | 3/1994 | European Pat. Off. . |
| 2 082 090 | 12/1971 | France . |
| 25 04 019 | 8/1976 | Germany . |
| 132 702 | 10/1978 | Germany . |
| 29 11 818 | 10/1980 | Germany . |
| 43 29 059 | 3/1995 | Germany . |
| 2-212097 | 11/1990 | Japan . |
| 3-277497 | 3/1992 | Japan . |
| 60-127968 | 7/1995 | Japan . |
| 2 219 245 | 12/1989 | United Kingdom . |
| 2 282 559 | 4/1995 | United Kingdom . |

*Primary Examiner*—M. Rachuba
*Assistant Examiner*—Ana Luna
*Attorney, Agent, or Firm*—Lowe Hauptman Gopstein Gilman & Berner

[57] ABSTRACT

The invention relates to an ultrasound cutting device comprising an ultrasound generator having a given natural frequency, coupled to a cutting tool. The cutting tool is a disk that is driven in rotation, and the ultrasound generator is coupled to a central region of the disk by a coupling means, said central region being disposed on an amplitude antinode of the ultrasound vibration produced by the ultrasound generator.

9 Claims, 5 Drawing Sheets

ULTRASONIC CUTTING DEVICE

The present invention relates to a device for cutting by ultrasound, the device comprising an ultrasound generator of given natural frequency coupled to a cutting tool.

BACKGROUND OF THE INVENTION

In industry, the action of cutting, and in particular cutting foodstuffs, can be performed using various available techniques including traditional devices such as guillotine cutting devices, or indeed devices that have been developed quite recently, such as cutting food by means of a supersonic jet of water. That technique constitutes the subject matter of an article by Jean-Luc BOUTONNIER published in the journal Revue des ENIL (No. 163), pp. 5 to 12.

Another technique that is known and relatively recent is that of the ultrasound knife. In particular, a cutting unit as described in Japanese patent application No. 4-75898, filed by NIGATA and published on Mar. 10, 1992, makes use of ultrasound knives that are driven with reciprocating motion, each knife being set into vibration by an ultrasound generator which is merely coupled to one end of the knife blade so as to cause it to vibrate. A similar technique is described in Japanese patent application JP-122 2892, also filed in the name of NIGATA, and published on Sep. 6, 1989.

The technique of cutting by means of ultrasonically-vibrating blades makes it possible to ensure that the cut is clean, but to the detriment of speed, it being understood that the linear travel speed of the products, and thus the linear speed of cutting, is limited to a speed which, in practice, hardly exceeds 1 meter per minute (m/min).

OBJECTS AND SUMMARY OF THE INVENTION

An object of the present invention is to provide an ultrasound cutting device which does not have the above-mentioned drawback, and which makes it possible in particular to achieve linear cutting speeds of several meters per minute, and which may be as great as 10 m/min.

Another object of the invention is to provide a cutting device making it possible to cut without removing material.

Another object of the invention is to provide a cutting device capable of being used for products that have the reputation of being difficult to slice, such as confectionery, bread, or indeed a sandwich loaf when hot on coming out of the baking oven.

Another object of the invention is to provide a cutting device that can be cleaned easily, and in particular that can be cleaned on a continuous basis, thereby enabling cutting to be performed under very clean conditions.

Another object of the invention is to provide a cutting device having improved coupling between the ultrasound generator and the cutting tool.

The device of the invention has a cutting tool which is a disk driven in rotation, and the ultrasound generator is coupled to a central region of the disk via a coupling means, said central region being disposed on an amplitude antinode of the ultrasound vibrations produced by the ultrasound generator in a given mode.

The cutting device of the invention thus uses a conventional ultrasound generator, and the function of the coupling means of the invention is to transform motion directly along the axis of the disk into motion putting the surface of the disk into vibration perpendicularly to said axis, either in a radial mode, or preferably in a bending mode.

The coupling means comprises a bar of length advantageously equal to half the wavelength $\lambda$ which, for the material constituting the bar, corresponds to the natural frequency f of the ultrasound generator. Said bar has an upstream end coupled to the ultrasound generator, and a downstream end coupled to the disk, the bar being of section that is not constant, decreasing from upstream to downstream. The bar preferably has an upstream region of length $\lambda/4$, a downstream region of length $\lambda/4$, with the downstream region being of constant section smaller than the section of the upstream region which is also constant.

The coupling means also includes a coupling element of length $\lambda/2$ extending the bar. The coupling element may be a cylindrical resonator, with the central region of the disk then being disposed on a longitudinal amplitude antinode so as to enable the preferred excitation mode of the disk by bending vibration. In a preferred embodiment, the central region of the disk is advantageously sandwiched between the downstream end of the bar and the upstream end of the coupling element.

The invention also provides a device wherein the cutting unit comprises a plurality of disks including at least one upstream disk coupled to the downstream end of the bar and a downstream disk coupled to the upstream end of said coupling element, the coupling element having a free downstream end, and wherein the disks are spaced apart from each other by intermediate coupling spacers so as to be disposed on vibration antinodes inducing displacement in bending mode.

Finally, the invention provides a device wherein the cutting unit comprises a plurality of disks including at least an upstream disk coupled to the downstream end of the bar and a downstream disk coupled to the upstream end of said coupling element, the coupling element having a free downstream end, and wherein the disks are spaced apart from each other by intermediate coupling spacers in such a manner as to be disposed at a pitch p that is substantially equal to one-fourth of the wavelength, and offset by one-eighth of the wavelength relative to vibration antinodes, producing displacement of the disks in a bending mode.

It is particularly advantageous for the cutting unit to include a central shaft on which there are mounted the spacers, the ultrasound generator, and a clamping device co-operating with the shaft to clamp the disks positioned between the spacers.

The disks may have annular recesses that conserve the circular symmetry of the disks. This makes it possible to reduce the weight thereof without spoiling the performance of the device.

The cutting unit may include an adjustment device, preferably an individual adjustment device for adjusting the clamping force on each disk.

The device may include n of said cutting units, each having a plurality of disks spaced apart from one another by nxa and offset relative to one another so as to produce cuts of equal thickness a.

The said cutting mode is preferably essentially free from any bending being imparted to the coupling element(s), in particular the spacers.

In a second variant, relating to excitation of the disk by radial vibration, the coupling element is a shaped piece whose diameter is preferably substantially equal to $\lambda/2$, and the central region of the disk is located on a radial amplitude antinode, i.e. on a longitudinal amplitude node. In particular, the central region of the disk may be disposed between two equal-length regions of the shaped piece, said equal-length regions then being capable of being symmetrical about the disks, and of presenting a diameter that decreases with increasing distance from the disk.

The invention also provides a use of the device as defined above for cutting products such as bread, sandwich loaf, or confectionery, more particularly while in the hot state, and in particular when said products leave the oven. The device of the invention may also be used, in particular, for cutting meat products, whether raw or cooked, or indeed salted products.

The frequency of the ultrasound generator advantageously lies in the range 20 kHz to 40 kHz, and the speed of rotation of the disk preferably lies in the range 100 revolutions per minute (rpm) to 800 rpm.

The amplitude of vibration of the disk advantageously lies in the range 15$\mu$ to 25$\mu$.

The linear travel speed of the product to be cut advantageously lies in the range 2 m/min to 10 m/min, thereby greatly improving industrial throughput compared with known ultrasound cutting tools which implement a knife or a reciprocating saw.

The invention also provides a method of cutting a product by ultrasound, the method implementing a device as defined above. In a preferred implementation, cutting is performed on the product leaving the oven and while in the hot state, cutting being followed by packaging of the product, thereby making it possible to obtain a very high standard of cleanliness. In particular, for products such as sandwich loaves, it is possible to avoid the previously necessary step of cooling off which requires rather a long period of time during which the product is exposed to ambient air and thus to microbial contamination, loss of weight, loss of softness, and the need to subject the product prior to drying to a special decontamination step ensuring subsequent conservation.

BRIEF DESCRIPTION OF THE DRAWINGS

Other characteristics and advantages of the invention appear better on reading the following description, given by way of non-limiting example and with reference to the accompanying drawings, in which.

MORE DETAILED DESCRIPTION

Figure 1:
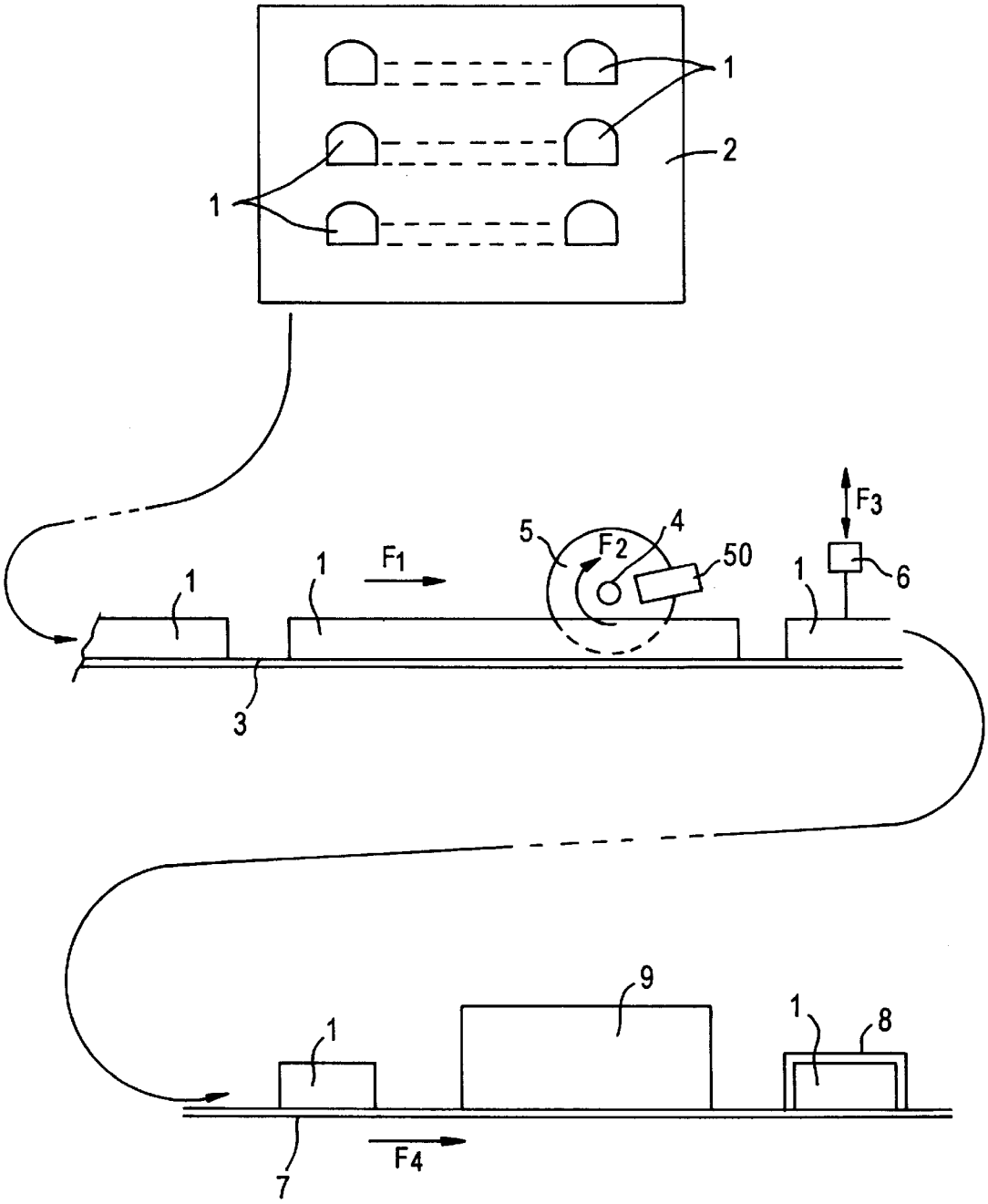
FIG. 1 is a diagram of the method of the invention applied to manufacturing sandwich loaves.

The invention thus seeks to provide a cutting unit which can be used under relatively difficult cutting conditions, in particular in association with confectionery or sandwich loaves while still hot after baking. It is particularly difficult, for example, to cut thin slices from a sandwich loaf that has just been baked. In practice, it must be allowed to stand during a cooling-off step that may be as long as 24 hours, and during which time the loaf loses some of its moisture. The loaf is then sliced and bagged. This operation suffers from the drawback not only of exposing the product to ambient air and contamination, but also of giving rise to a product that is harder than it would have been if it could have been cut immediately, and even though it is subjected to a special decontamination step, its shelf life is relatively short. As explained below, by cutting the product while it is still hot and then bagging it immediately, it is possible to avoid all of the above-mentioned drawbacks, giving rise to a product whose eating qualities are improved and whose shelf life is considerably increased.

Difficulties in cutting can be explained as follows.

When the blade enters a material with a certain speed and a certain mass, it can be assumed that essentially two types of phenomena take place as described by the authors DAURSKIJ and MATCHIKHINE:

- stress is established which deforms the product, and then causes it to break; and
- contact between two entities moving in opposite directions gives rise to friction forces which tend to slow down penetration of the tool into the product.

A solid material is cut as a result of three phenomena occurring in succession, namely: elastic deformation; plastic deformation; and propagation of a break line.

Three notions are thus essential for describing the different kinds of deformation behavior of solid materials:

- elastic deformation: the deformation is reversible;
- plastic or viscous deformation: the deformation is irreversible and the material flows by layers slipping over one another. In most solid materials, this phenomenon gives rise to flow above a certain stress threshold greater than the limit of the elastic phase; and
- breakage: if the stress or the deformation of the material continues to be increased once it is in its plastic or viscous phase, slip of the layers relative to one another is increased, and there comes a moment when some layers are no longer in contact and a crack appears. This crack (which propagates in application of laws that are highly complex) leads to breakage through the entire thickness of the material.

The purpose of cutting is to achieve controlled breakage of a material.

In the elastic phase, energy is stored and it is completely restored when the stress drops to zero such that the material returns to its initial shape.

In the viscous or plastic phase, energy is used to deform the material by causing layers to slip relative to one another, and energy is thus consumed to overcome friction forces and the deformation persists when the stress or the deformation ceases.

In the breakage phase, energy is used to cause the crack to progress, and it is therefore completely consumed by creating new surfaces.

When cutting is performed, the material is subjected for a very short length of time to stress that is greater than its breaking stress. Account is not always taken of the parameters that characterize the elastic phase since it is often negligible compared with the plastic phase, particularly when deformation takes place quickly. The parameters that are most important are those which characterize the flow phase of the material.

In practice, the three phases: elastic, plastic, and breakage, always occur in that order when a solid material is cut, however they are manifest to a greater or lesser extent depending on the nature of the material. For example, agarose behaves essentially in elastic manner, butter essentially in plastic manner, and chocolate behaves essentially by crack propagation.

In most materials, there is often a combination of all three types of behavior.

When cutting, it is desirable to remain in control of the shape of the line of cut so as to obtain pieces of desired shape. Unfortunately, with any given material, it is not always possible to control its deformation at a given level of stress. This is particularly true of foodstuffs which have numerous characteristics that vary over time before reaching an equilibrium state. In addition, the appearance of cracks within the material remains quite random. To avoid that, cutting is generally practiced by erosion or abrasion, i.e. a cutting tool is used as best represented by the saw. The cutting edge is machined perpendicularly to the tool and small quantities of material are thus deformed on the surface, which is easier to control but that leads to a cut that removes material.

With a cutting tool, the material is thus subjected very quickly to stress in excess of its breaking strength and, at each point on the line of cut, the three deformation phases (elastic, plastic, and breakage) arise in succession, even though throughout the duration of the cutting operation all three phases coexist in the thickness of the material.

Referring to the specific case of a newly-baked sandwich loaf, it is observed that this product is difficult to cut into thin slices because it tends to become sticky and to generate irregular fractures in lumps.

The advantage of the ultrasound cutting technique of the invention as described below is that it modifies that behavior and, by implementing a tool that is preferably circular, that has no teeth, and that is put into vibration, it makes it possible to achieve regular separation of the substance to be cut and to achieve a clean cut through the product, preferably without removing any material. Since cutting is performed by a disk which is rotating continuously, the drawbacks of ultrasound knives are avoided since, given that they are subjected to reciprocating motion, they move at a speed that becomes zero each time the direction of movement is reversed, and that constitutes a major drawback when cutting a "sticky" product since there is a tendency for the knife blade to clog up quickly, and the blade cannot be cleaned without interrupting the cutting operation.

As shown in FIG. 1, products such as sandwich loaves, given general reference 1, are baked in an oven 2 and are then taken by a conveyor 3 such as an endless belt moving longitudinally in the direction of arrow $F_1$ to a cutting installation having one or more disks 5 that are rotated in the direction of arrow $F_2$ about a central portion 4. The installation may also include a guillotine cutting device 6 actuated in the direction of arrow $F_3$ for the purpose of performing slicing upstream from the disk 5, or downstream therefrom, as shown. The product that has been sliced in the hot state is then placed on a second conveyor device 7 and transported in the direction of arrow $F_4$ to a bagging installation 9 where the products 1 are put into bags 8.

The rotary disk 5 is subjected to ultrasonic vibration generated by a device described below and enabling high linear speeds to be achieved for the conveyor device 3, while still allowing thin slices to be cut in sandwich loaves on leaving the oven.

It will also be observed that since only a portion of the circumference of the disk is in contact with the product being cut, the disk can be cleaned and/or disinfected continuously by a conventional device 50.

Figure 2B:
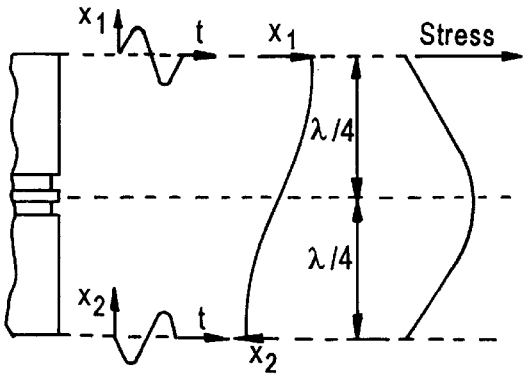
FIGS. 2*a* and 2*b* show an ultrasound generator together with diagrams of stress and of elongation respectively.
Figure 2A:
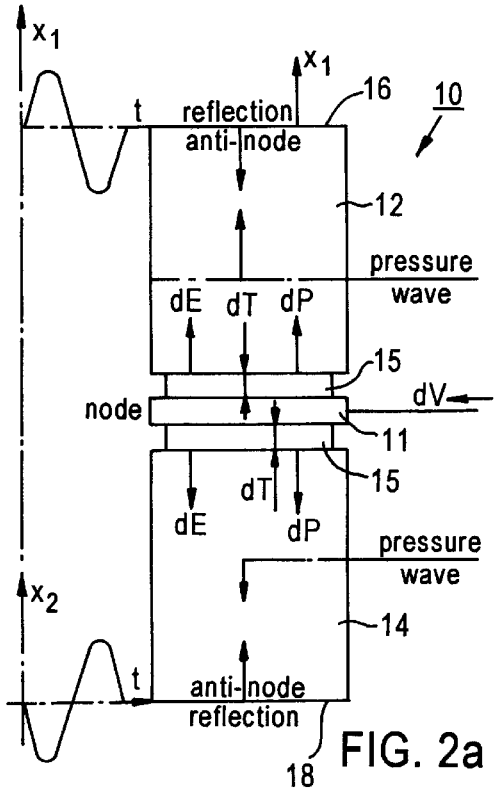

FIG. 2*a* shows a conventional ultrasound emitter given overall reference 10. It is constituted by a sandwich of piezoelectric ceramics 11, e.g. made up of two disks prestressed between two metal masses, namely a top mass 12 and a bottom or countermass 14. Regions 15 extend between ceramics 11 and top mass 12, and between ceramics 11 and bottom 14. The assembly vibrates at mechanical resonance with electrical excitation supplied by the generator 11. To this end, the ceramics have applied thereto an alternating voltage dV corresponding to alternating variation of the electric field dE thus giving rise to an alternating variation in the thickness dT of the ceramics. Each thickness variation dT then corresponds to a pressure variation dP. By applying an alternating voltage dV to the terminals of the emitter made in this manner, pressure waves are generated which, starting from the two ceramic disks, are reflected at the ends 16 and 18 of the emitter.

If the length of one of the bars is given a value such that the frequency of longitudinal vibration thereof corresponds exactly to the electrical excitation frequency f, the bar becomes the seat of standing waves and vibrates resonantly with electrical excitation. This condition is obtained for a bar 10 whose total length, between its end faces 16 and 18 is equal to $\lambda/2$, where $\lambda$ is the length of waves in the bar corresponding to the frequency f. The ceramics 11 are disposed in the center, and the top and bottom masses 12 and 14 are disposed symmetrically about the ceramics 11.

Since the vibration that can be obtained in practice from the emitter 10 has a peak-to-peak amplitude of about $10\mu$ to $14\mu$, depending on the type of generator used, it is necessary to amplify the vibration in order to obtain sufficient amplitude.

Figure 2C:
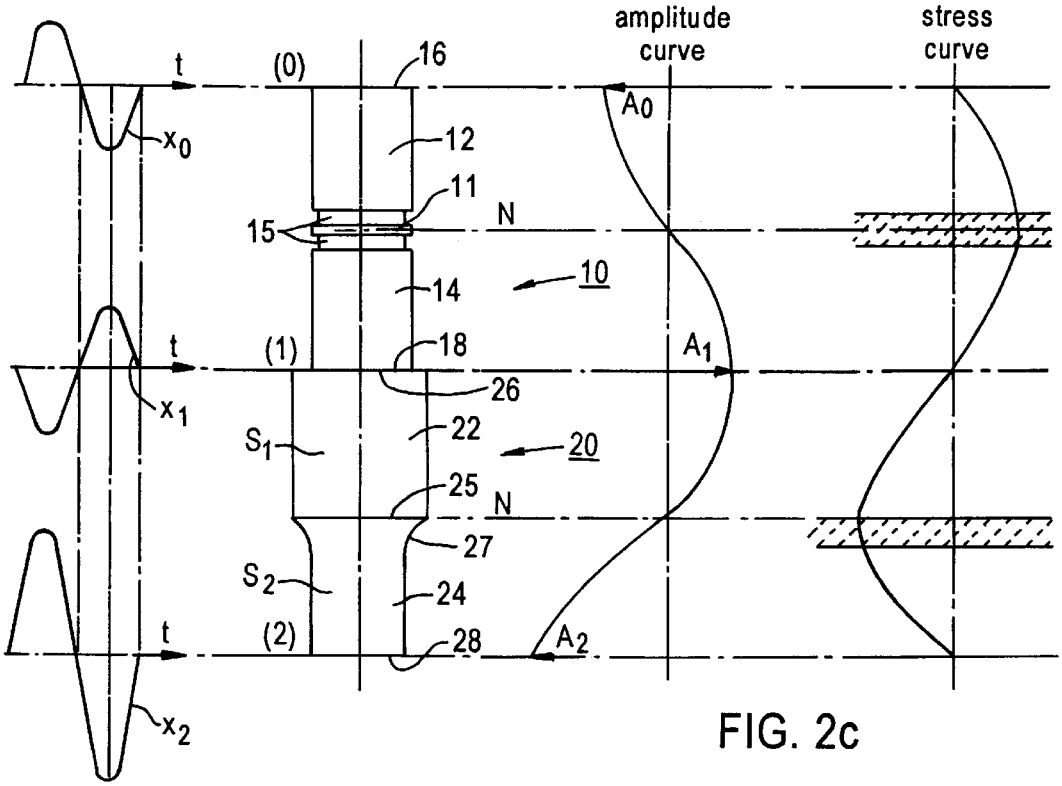
FIG. 2*c* shows the FIG. 2*a* ultrasound generator associated with an amplifier bar serving to amplify the amplitude of ultrasound vibration, this figure also giving the corresponding stress and amplitude diagrams.

To this end, and as shown in FIG. 2*c*, a metal bar is fixed to the emitter, which bar is of length $\lambda/2$ tuned to the natural frequency of the emitter, for example 20 kHz. The bar 20 has a first segment 22 of length $\lambda/4$and of constant section $S_1$ greater than the also constant section $S_2$ of its second segment 24, likewise of length $\lambda/4$. The face 26 of the segment 22 is adjacent to the face 18 of the countermass 14. Beginning at an end face 25 of segment 22, section $S_1$ tapers towards section $S_2$ over a tapered region 27. The diagram of amplitudes and stresses is given in FIG. 2*c* where motion of the face 16 is represented by curve $x_0$, motion of the faces 18 and 26 by curve $x_1$, and motion of the face 28 of segment 24 by curve $x_2$.

It is explained above that the emitter-amplifier assembly produces longitudinal ultrasound vibration. Since the disk 5 can be excited only at center 4, i.e. on its axis of rotation, it is essential to transform the initial axial motion into radial motion lying in the plane of the disk.

Two embodiments of the invention are envisaged.

Figure 3A:
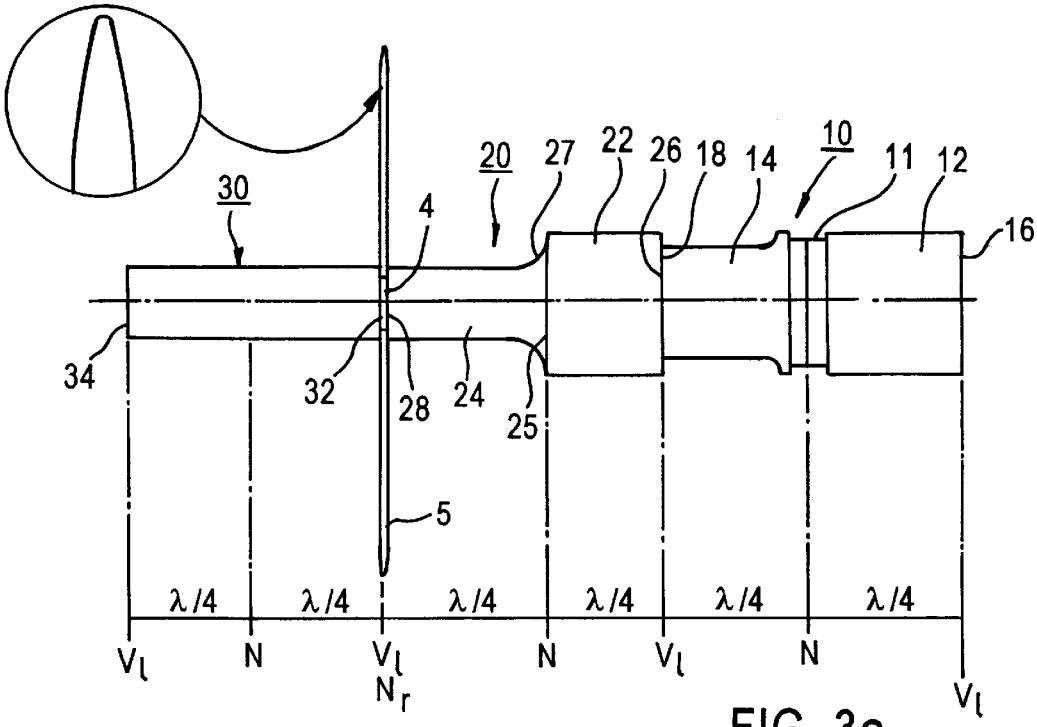
FIGS. 3*a*, 3*b*, and 3*c* show respectively a preferred embodiment of the cutting device of the invention, implementing excitation of a disk in bending, an embodiment of the device of the invention implementing radial excitation of the disk, and finally diagrams showing the longitudinal and radial amplitudes along the above-mentioned cutting device.

In FIG. 3*a*, the disk 5 is sandwiched between the face 28 of the segment 24 and the face 32 of a resonator 30 which is a cylindrical bar of length $\lambda/2$ terminated by a free end face 34. The bar 30 acts as a resonator and its function is to return waves when the assembly is in a condition of mechanical resonance. Motion is transformed because the disk 5 is situated, as shown by longitudinal amplitude curve $a_1$, on a longitudinal amplitude antinode $V_1$. It vibrates in a bending mode that is independent of its diameter. In practice, its thickness lies in the range 2 mm to 4 mm so as to remain as close as possible to the theoretical position of the longitudinal amplitude antinode $V_1$, and thus enable maximum deformation in bending. The profile of the edge of the disk 5 is shown on a larger scale in a detail. In the vicinity of the edge of the disk, its thickness decreases on approaching the edge of the disk, it being understood that in order to perform cutting without removing material, the profile is smooth and has no teeth or serrations.

Figure 3B:
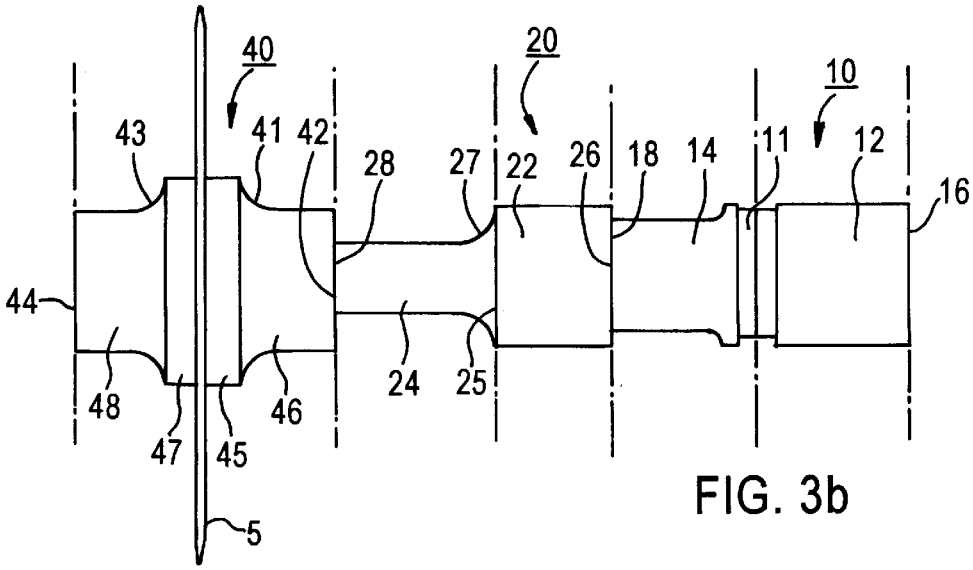
Figure 3C:
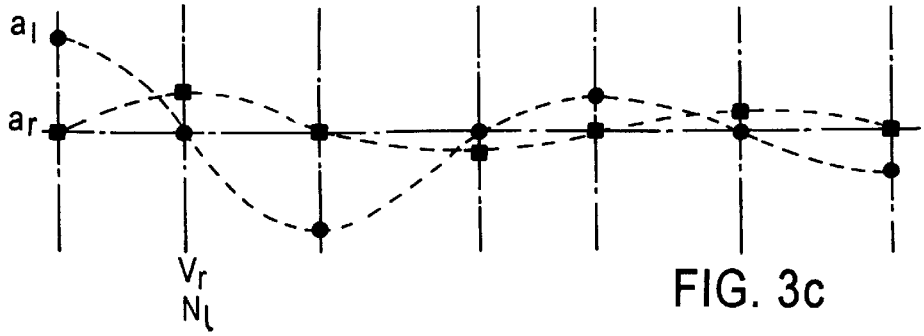

The embodiment of FIG. 3*b* makes use of an element 40 for transforming axial motion into radial motion. It is fixed in the vicinity of a radial amplitude antinode $V_r$ corresponding to an axial amplitude node. The element 40 is generally cylindrical in shape and has an upstream segment 46 whose face 42 is adjacent to the face 28 of the segment 24, and a downstream segment 48 having a free face 44. The disk 5 is located at the center of the element 40 between two ring regions 45 and 47 of diameter greater than the regions 46 and 48 to which they are joined by rounded profiles 41 and 43. The diameter of the regions 46 and 48 is greater than that of the region 24, and in the example shown, substantially equal to the diameter of the region 22. The length of the element 40 between its faces 42 and 44 is equal to $\lambda/2$ and the disk 5 is therefore located at a distance $\lambda/4$ from the face 28. Under such conditions, it is fixed in the vicinity of a radial amplitude antinode $V_r$, as shown by curve $a_r$ in FIG. $\mathbf{3}_c$. In practice, a conical profile ought to be adopted for a thickness at the base of about 10 mm. The regions 45 and 47 of the element 40 have a diameter that is close to $\lambda/2$, thereby establishing resonance conditions radially. That is how sufficient radial amplitude can be obtained for exciting the disk 5.

Concerning materials, the pieces 12, 14, 20, and 30 may advantageously be made of the TA6V titanium alloy which has excellent properties of elasticity, and which is biocompatible, i.e. chemically inert relative to the products that are to be cut. In addition, this alloy is stainless, easily machined, and affordable in the intended applications.

As for the disk 5, the above alloy may be recommended, however for this piece which is subject to wear and will therefore need replacing, it is preferable to use an alloy that is less expensive, such as a stainless steel alloy of the type used for conventional cutting tools, and in particular the alloy Z200C13 which combines all of the looked-for qualities, namely: chemical inertness, machineability, a high degree of hardness, and acceptable cost. Its elastic properties are not as good as those of the above-mentioned titanium alloy, but they are sufficient for the intended application.

By way of indication, it is recalled that the speed of sound in the TA6V alloy is 4900 meters per second (m/s) whereas it is 5200 m/s in the Z200C13 stainless steel alloy.

Tests have been performed which show that systems operating in bending mode (FIG. 3*a*) have an overall resonant frequency which is determined by the end resonator 30. As a result, the diameter of the disk 5 has little influence on the frequency of the assembly. Its thickness may need to be taken into account however since it forms an integral portion of the axial stack which also includes the emitter 10, the amplifier 20, and the resonator 30.

In bending mode, a cutting disk having a diameter of 600 mm makes it possible to cut a product that is 280 mm tall. It is possible to cut products that are even taller, but to the detriment of fineness of cut, given that under such circumstances, it is necessary to increase the thickness of the blade.

Unlike the bending configuration, the radial mode configuration, shown in FIG. 3*b*, has a resonant frequency which depends on the diameter of the disk 5. For example, the diameter which is resonant at 40 kHz lies around 200 mm.

Figure 4A:
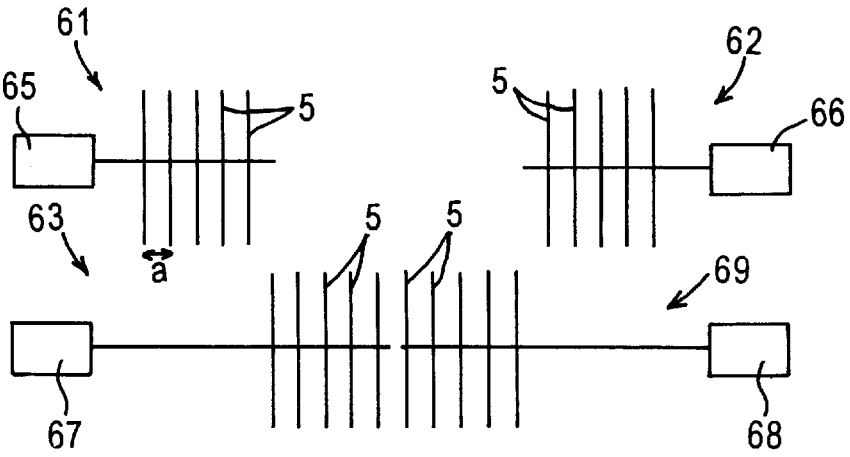
FIGS. 4*a* and 4*b* show two variants multiblade cutting units of the invention.
Figure 4B:
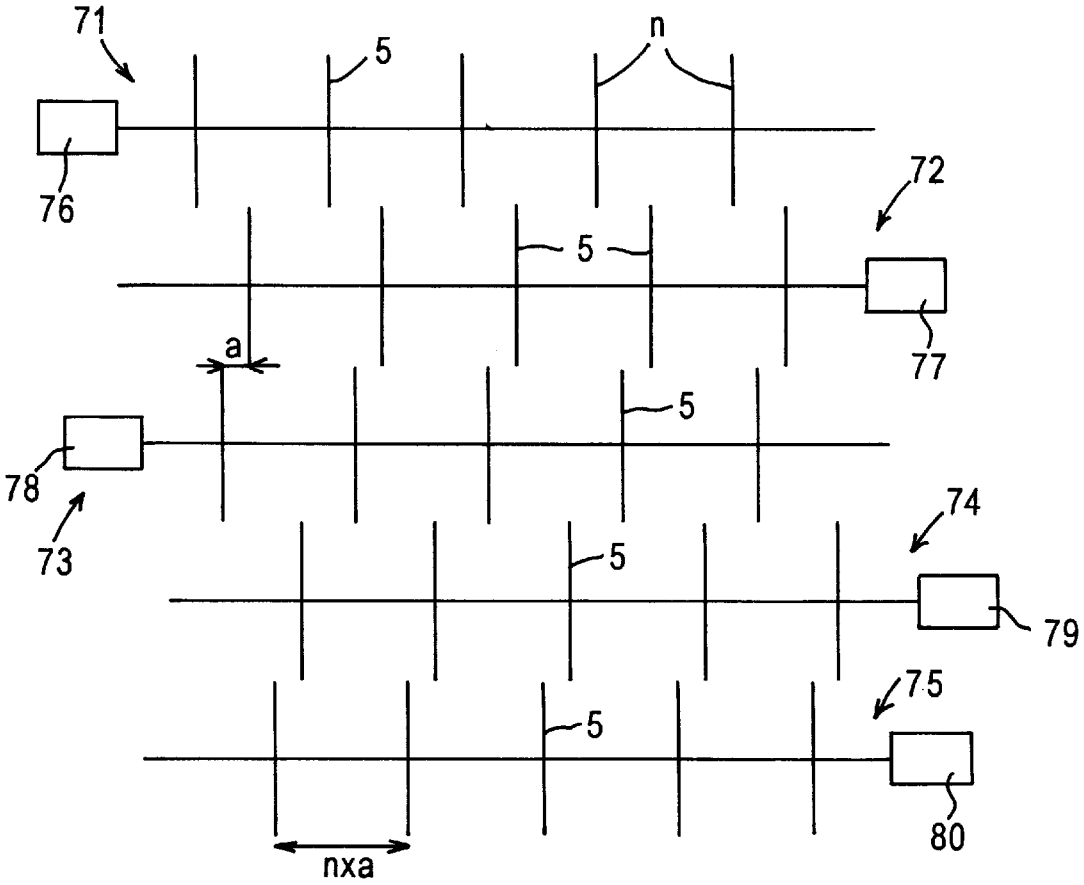

FIGS. 4*a* and 4*b* show two variant machines serving more particularly to slice bread products or cakes, e.g. to slice sandwich loaf having a height of about 120 mm, with the thickness a of the slices to be made being 12 mm 11 mm.

In practice, about 20 blades are required.

Nevertheless, such a configuration is difficult to implement since a blade having a diameter of 300 mm and a thickness of 2 mm weighs about 1 kilogram: so for 20 blades it is necessary to put 20 kg into vibration which is to be distributed over the diameter.

In accordance with the invention, two possibilities can be envisaged by way of example:

- a plurality of blade systems (61 to 64) can be provided fitted with a corresponding number of ultrasound generators (65 to 68), each system having blades at 12 mm intervals (FIG. 4*a*); or
- n blade systems can be provided (71 to 75) fitted with a corresponding number of ultrasound generators (76 to 80) with the inter-blade spacing being n×12 mm (FIG. 4*b* where n=5).

In the first case (FIG. 4*a*) there is no offset in the cutting front between slices. Nevertheless this solution suffers from a problem of implementing ultrasound waves since the inter-blade interval of 12 mm±1 mm is in direct relationship with the excitation frequency of the system. This leads to a frequency in excess of 100 kHz for this spacing of 12 mm, which frequency is too high for effective vibration power to be transmitted to the blades constituted by the disks 5.

In the preferred case (FIG. 4*b*), since the blades (disks 5) are offset, the cutting front is no longer parallel, which can lead to difficulties while the product is being engaged. Nevertheless, the spacing between the disks 5 makes it possible to use a lower frequency which is more compatible with the dimensions of the disks 5. The difficulties that might arise during engagement of the loaf are not very great. Tests on a single disk prototype have shown that blade penetration into the bread is greatly improved by the presence of the ultrasound. For systems that are sufficiently interleaved, the bread does not separate too soon. In addition, the ultrasound greatly reduces the apparent coefficient of friction between the material and the vibrating disks, so, a priori, the disks 5 do not tend to hold back the bread as it goes past.

In both examples of FIG. 4*a* and of FIG. 4*b*, the disk assembly 5 in each cutting unit is coupled to a common axis set into vibration by an ultrasound generator. The disks 5 are located at longitudinal vibration antinodes (or close to such antinodes). It is appropriate to adjust the clamping force on the disk 5 so as to ensure good ultrasound coupling, and in particular a uniform amplitude of displacement for all of the disks, which can advantageously be obtained by individually adjusting the clamping of each disk 5, e.g. by having the collars 92 threaded and capable of being tightened relative to the centering region 98 which is likewise threaded.

Figure 5:
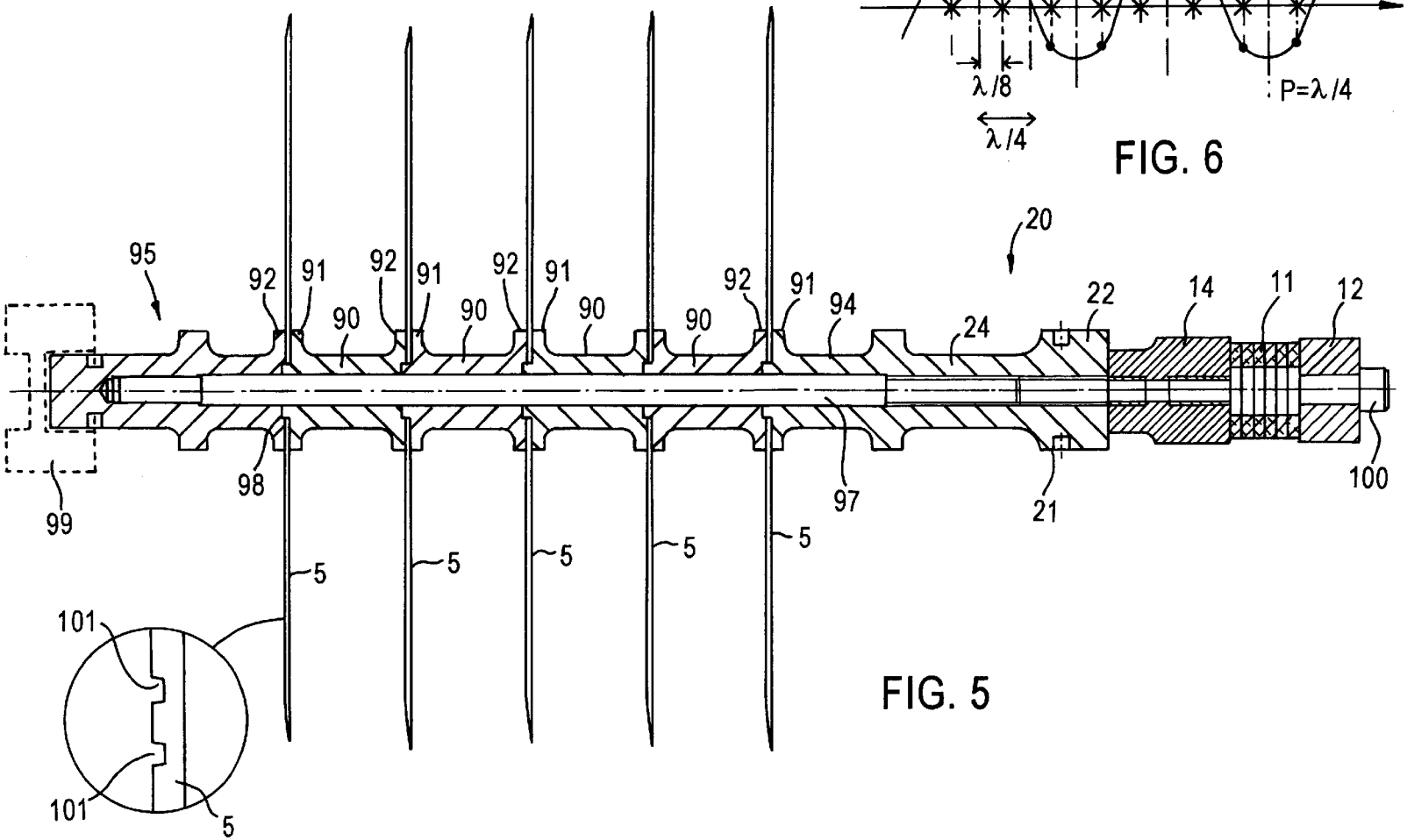
FIG. 5 shows a first embodiment of a multiblade cutting unit of the invention.

As shown in FIG. 5, the disks are mounted on a shaft 97 by means of spacers 90 which slide along the shaft 97 with the disks 5 being sandwiched between them, overall clamping being provided by a plug 99 so as to hold the disks 5 securely and to increase the transmission area in contact with the disks 5. An end piece 100 is used for mounting assembly 11, 12, 14 on shaft 97, in cooperation with plug 99 and plug end spacer 95 at the opposite side.

There exist several modes enabling the disks 5 to operate in bending. For an inter-blade distance of 60 mm, a first mode is situated around 30 kHz and makes it possible to obtain good displacement in translation via the spacers 90 so as to induce bending motion in the disks 5.

The second mode is situated around 36 kHz and, in contrast, operates by causing bending of the spacers 90 which are in contact with the disks 5.

It has been observed by experiment that when ultrasound is transmitted via interfaces that are subjected to bending, the quality of the transmission is less good. Since the link is not perfect, the various portions are no longer in intimate contact.

That is why the mode around 30 kHz is preferred, since it has essentially no bending at the interface 90.

It is observed that with identical spacers, the mode used in a system having two to four blades remains unchanged at practically the same frequency. It can be observed that a system designed for an even (or odd) number of blades continues to be usable with a greater or smaller number of blades providing the number remains even (or odd).

The shape of the blade has some influence on frequency: the lighter the blade and above all the more flexible, the greater the extent to which the frequency is lowered. With blade diameter being fixed at 300 mm, it is possible to lighten the disk 5 by hollowing it out regularly by means of rings 101 (see detail in FIG. 5). The disk-shaped blade continues to be circularly symmetrical.

The blade thickness, initially of 2.5 mm, is fixed at 2 mm to lower the mass to be put into vibration and to increase the flexibility of the blade.

Concerning the influence of inter-blade distance, the following points have been observed:

with the intended blades (Ø 300 mm thickness 2 mm), it is possible without too much difficulty to work with an inter-blade distance of 48 mm (giving a pitch of 50 mm);

the smaller the inter-blade distance, the more the asymmetry of the spacer needs to be taken into account: the two ends of the spacer are closer together and it becomes more difficult to place a node (equilibrium) at equal distances from both ends; and the smaller the inter-blade distance, the greater the number of blades that needs to be implemented in any one system. Damping and losses not included in the calculations can become preponderant and run the risk of giving rise to significant malfunction of the end blades.

In practice, it is possible to use spacers 90 in the form of straight tubes fitted at their ends with add-on collars 91 and 92 centered on one another and also centering the disks 5 (FIG. 5). The disk-shaped blades 5 are regularly spaced apart so as to be situated at vibration antinodes, corresponding to the disks 5 being set into vibration in bending mode.

It is particularly advantageous to decouple the ultrasound generator (11, 12, 14) and the tool-carrying assembly (97, 90, 5) mechanically from the portion that supports and rotates the cutting unit, e.g. by coupling the support and rotary drive device to the housing of the ultrasound generating transducer. In this way, the excited portion is much shorter, ultrasound excitation is more direct, thereby minimizing ultrasound losses in the supports (such as bearings and belts) between the exciter device and the disks 5, and disassembly is also made easier, whether for cleaning or for repair.

With an odd number of blades (five blades) it is necessary to change the dimensions of the first and last spacers 94 and 95 which are, in any event, geometrically different from the others in that one of them bears against the ultrasound generator (14, 11, 12) and the other bears against the plug 99 (at the end of the tool).

The assembly comprising the exciter plus the tool is made up of:

an ultrasound driver (14, 11, 12, cf. FIG. 3*a*);

a mechanical matching portion (amplifier) 24;

a shaft 97 which is fixed in the amplifier 24;

five disk-shaped blades 5;

a spacer 94 at the ultrasound generator end;

four spacers 90 keeping the blades spaced apart by 48 mm edge to edge (50 mm center to center);

a plug end spacer 95 which may be integrated in the plug 99, said spacer being dimensioned to reflect the wave; and a plug 99 which is screwed onto the shaft 97 for clamping the assembly.

The nominal operating frequency is 32.2 kHz.

Centering elements are provided on all of the pieces, as are severe tolerances and surface states so as to ensure best possible quality for mounting and assembly.

If necessary, locating a node plane 21 in the amplifier portion 22 makes it possible to install a stainless steel plate for the purpose of isolating the slicing zone, for reasons of ultra-cleanliness.

By way of example, it may be envisaged to work with 7-blade units with an outside diameter of 210 mm and an inter-blade distance of 36 mm, or with 11-blade units having an outside diameter of 150 mm and an inter-blade distance of 24 mm, with the frequencies in those two cases lying, for example, in the range 35 kHz to 40 kHz for blades at a pitch that is substantially equal to half a wavelength.

Figure 6:
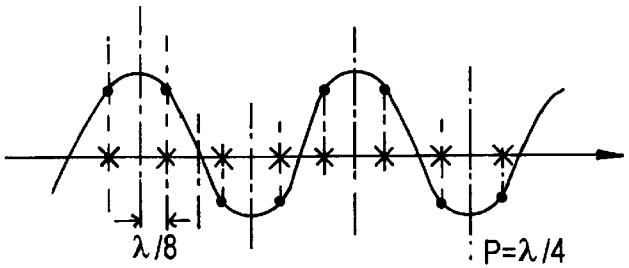
FIG. 6 shows a preferred embodiment of a multiblade cutting unit of the invention.

An embodiment that enables the operating frequency to be lowered consists in placing the blades or disks 5 at a constant pitch p that is substantially equal to one-fourth of a wavelength, with the blades being offset longitudinally for this purpose by about one-eighth of a wavelength ($\lambda/8$) relative to the longitudinal vibration antinodes (see FIG. 6). With a pitch of 50 mm, the frequency is of the order of 22 kHz, for the example shown in FIG. 5.

To define a multiblade unit, blade diameter is selected, as are blade pitch and the geometrical characteristics of the pieces making them up (spacers, etc. . . . ). Calculations, e.g. using the method of finite elements, serves to determine the wavelength $\lambda$ that corresponds to the structure. This wavelength $\lambda$ depends on the configuration of the pieces, i.e. a shape factor is involved in their design. In particular, the cutting unit shown in FIG. 5 makes use of tubular spacers 90 and of a shaft 97 clamped by a plug 99, and this situation has an influence on the wavelength.

I claim:

1. A device for cutting by ultrasound, the device comprising at least one cutting unit including an ultrasound generator having a given natural frequency, coupled to at least one cutting tool, in which cutting unit the cutting tool is a disk driven in rotation, and the ultrasound generator is coupled to a central region of the disk via a coupling means, said central region being disposed on an amplitude antinode of the ultrasound vibration produced by the ultrasound generator in a given mode, or in the vicinity of said antinode, wherein the coupling means includes a bar of length $\lambda/2$ equal to half the wavelength $\lambda$ corresponding to the natural frequency F of the ultrasound generator, and having an upstream end coupled to the ultrasound generator and a downstream end coupled to the disk, the bar being of non-constant section that decreases from the upstream end towards the downstream end, and wherein the coupling means also includes a coupling element of length $\lambda/2$ which has an upstream end coupled to the central region of said cutting disk and a free downstream end so as to ensure that waves are returned.

2. A device according to claim 1, wherein the bar has an upstream region of length $\lambda/4$ and a downstream region of length λ/4, the downstream region being of constant section smaller than the section of the upstream region which is also constant.

3. A device according to claim 1, wherein the cutting unit includes one cutting tool and the coupling element is a cylindrical resonator, the central region of the disk being sandwiched between the downstream end of the bar and the upstream end of the coupling element.

4. A device according to claim 1, wherein the cutting unit includes a plurality of disks including at least one upstream disk coupled to the downstream end of the bar and a downstream disk coupled to the upstream end of said coupling element having the free downstream end, and wherein the disks are spaced apart from one another by at least one intermediate coupling spacer in such a manner as to be located on vibration antinodes causing them to be moved in bending mode.

5. A device according to claim 3, wherein the cutting unit includes a plurality of disks including at least one upstream disk coupled to the downstream end of the bar and a downstream disk coupled to the upstream end of said coupling element having the free downstream end, and wherein the disks are spaced apart from one another by intermediate coupling spacers, the disks being separated from one another by a distance substantially equal to λ/4, the disks being positionally offset from the vibration antinodes by a distance substantially equal to λ/8, whereby the disks are displaced in bending mode.

6. A device according to claim 4, wherein the cutting unit includes a central shaft on which there are mounted the spacers and the ultrasound generator, and a clamping device co-operating with the shaft to clamp the disks that a repositioned between the spacers.

7. A device according to claim 4, wherein the disks have ring-shaped recesses that conserve circular symmetry of the disks.

8. A device according to claim 4, including a preferably individual adjustment device for adjusting the clamping force on the disks.

9. A device according to claim 4, including n of said cutting units, each having a plurality of disks that are spaced apart relative to one another by n×a and that are offset relative to one another so as to produce slices of equal thickness a.

* * * * *